US006674405B2

(12) United States Patent
Wang

(10) Patent No.: US 6,674,405 B2
(45) Date of Patent: Jan. 6, 2004

(54) DUAL-BAND MEANDERING-LINE ANTENNA

(75) Inventor: Chien-Jen Wang, Kao-Hsiung Hsien (TW)

(73) Assignee: BenQ Corporation, Tao-Yuan Hsien (TW)

( * ) Notice: Subject to any disclaimer, the term of this patent is extended or adjusted under 35 U.S.C. 154(b) by 0 days.

(21) Appl. No.: 09/683,643

(22) Filed: Jan. 29, 2002

(65) Prior Publication Data

US 2002/0118142 A1 Aug. 29, 2002

(30) Foreign Application Priority Data

Feb. 15, 2001 (TW) ..... 90103477 A

(51) Int. Cl.[7] ..... H01Q 1/24

(52) U.S. Cl. ..... 343/700 MS; 343/806; 343/895

(58) Field of Search ..... 343/700 MS, 702, 343/846, 895, 806

(56) References Cited

U.S. PATENT DOCUMENTS

| | | | | |
|---|---|---|---|---|
| 5,450,090 A | | 9/1995 | Gels et al. | |
| 5,892,490 A | | 4/1999 | Asakura et al. | |
| 6,031,731 A | * | 2/2000 | Suesada et al. | 361/800 |
| 6,249,255 B1 | * | 6/2001 | Eggleston | 343/702 |
| 6,292,154 B1 | * | 9/2001 | Deguchi et al. | 343/806 |
| 6,329,962 B2 | * | 12/2001 | Ying | 343/895 |
| 6,404,394 B1 | * | 6/2002 | Hill | 343/702 |

FOREIGN PATENT DOCUMENTS

| | | |
|---|---|---|
| EP | 0 766 340 A2 | 4/1997 |
| EP | 0777293 A1 | 6/1997 |
| EP | 0 814 536 A | 12/1997 |
| EP | 0 869 579 A1 | 10/1998 |
| EP | 0 878 863 A2 | 11/1998 |
| EP | 0 896 384 A2 | 10/1999 |
| WO | WO 93/12559 /a1 | 6/1993 |
| WO | WO 97/49141 | 12/1997 |
| WO | WO 99/22420 | 5/1999 |
| WO | WO 01/08254 A1 | 2/2001 |

* cited by examiner

*Primary Examiner*—Hoang V. Nguyen
*Assistant Examiner*—Shih-Chao Chen
(74) *Attorney, Agent, or Firm*—Winston Hsu

(57) ABSTRACT

A microstrip meandering-line antenna for a wireless communications system includes a substrate, a meandering-line conductor, and a feeding wire. The substrate, which is made of a dielectric material or a magnetic material, has a first surface. The meandering-line conductor is attached to the first surface in a reciprocating bent manner for receiving radio signals, and the meandering-line conductor has a mid-point connection between two ends of the meandering-line conductor. The feeding wire is electrically connected to the mid-point of the meandering-line conductor for transmitting a received radio signal to the wireless communications system.

13 Claims, 10 Drawing Sheets

DUAL-BAND MEANDERING-LINE ANTENNA

BACKGROUND OF INVENTION

1. Field of the Invention

The present invention relates to a microstrip meandering-line antenna, and more particularly, to a dual-band microstrip meandering-line antenna.

2. Description of the Prior Art

Recently, the demand for antennas in mobile wireless applications has increased dramatically, and there are now a number of land and satellite based systems for wireless communications using a wide range of frequency bands. Accordingly, there is a need for a single antenna operable in two or more separate frequency bands. Typically, an antenna used in a conventional wireless communications system is a quarter-wavelength monopole antenna or a helix antenna. Nevertheless, since the dimensions of both types of antennas are large, it is difficult to use these antennas in a case in which a compact antenna is required. Therefore, the quarter-wavelength monopole antenna or the helix antenna tends to be replaced by other antennas.

Three types of antennas are candidates for using in a wireless communications system: a patch antenna, a ceramic chip antenna, and a microstrip meandering-line antenna. However, the first two types have their own shortcomings. The patch antenna is restricted by its narrow bandwidth. The ceramic chip antenna is difficult to conform to the specific absorption rate (SAR) standard, so it is not suitable for commercial products. In contrast to the these two types of antennas, the microstrip meandering-line antenna has a wider bandwidth, a lower cost, and can easily be integrated into a circuit board without an additional welding process, giving it the highest potential to be employed in the wireless communications system.

U.S. Pat. No. 5,892,490 discloses a microstrip meandering-line antenna as shown in FIG. 1. FIG. 1 is a perspective view of a microstrip meandering-line antenna 10 according to this prior art. The prior art microstrip meandering-line antenna 10 comprises a substrate 12, a meandering-line conductor 14 disposed inside the substrate 12 for transmitting and receiving radio signals, and a feeding terminal 16 for applying a voltage to the meandering-line conductor 14. Although the microstrip meandering-line antenna 10 has a wider bandwidth and a lower cost, it has only a single resonant frequency. Thus, the meandering-line antenna 10 cannot satisfy the requirement for a dual-band or multi-band wireless communication apparatus.

In addition, EP 0 777 293 A1 discloses a dual-band microstrip meandering-line antenna as shown in FIG. 2. FIG. 2 is a perspective view of a microstrip meandering-line antenna 20 according to this prior art. Differing from the meandering-line antenna 10, the meandering-line antenna 20 comprises two meandering-line conductors 22*a*, 22*b* disposed on two different layers of a substrate 24 so as to resonate within two different frequency bands.

However, since the two meandering-line conductors 22*a*, 22*b* are disposed on the two different layers of the substrate 24, the meandering-line antenna 20 is complicated and requires a complex manufacturing process. In general, a conductor, which receives radio signals, cannot be disposed near a high frequency circuit due to mutual interference. That is, a distance d1 shown in FIG. 2 must be quite large. Moreover, under the restriction of the two-layer structure, a distance d2 for separating the two layers should be large as well. Therefore, the physical size of this antenna is difficult to shrink.

Additionally, as the resonant frequency is lowered, the corresponding wavelength is lengthened. As a result, the length of the antenna is required to be extended. Therefore, for using a low resonant frequency in the meandering-line antenna 20, the lengths of the two meandering-line conductors 22*a*, 22*b* are increased, which adversely affects the current trend towards a thinner, lighter wireless communications system.

SUMMARY OF INVENTION

It is therefore a primary objective of the claimed invention to provide a dual-band microstrip meandering-line antenna with a meandering-line conductor attached to a surface of a substrate to solve the above-mentioned problems.

According to the claimed invention, a meandering-line antenna for a wireless communications system comprises a substrate having a first surface, a meandering-line conductor, which is attached to the first surface in a reciprocating bent manner for receiving radio signals, having a mid-point connection between two ends of the meandering-line conductor, and a feeding wire electrically connected to the mid-point connection for transmitting a received radio signal to the wireless communications system.

It is an advantage of the claimed invention that the dual-band meandering-line antenna can take advantage of a decreased volume and a simplified structure so as to reduce manufacturing complexity and improve the design.

These and other objectives of the claimed invention will no doubt become obvious to those of ordinary skill in the art after reading the following detailed description of the preferred embodiment, which is illustrated in the various figures and drawings.

DETAILED DESCRIPTION

Figure 3:
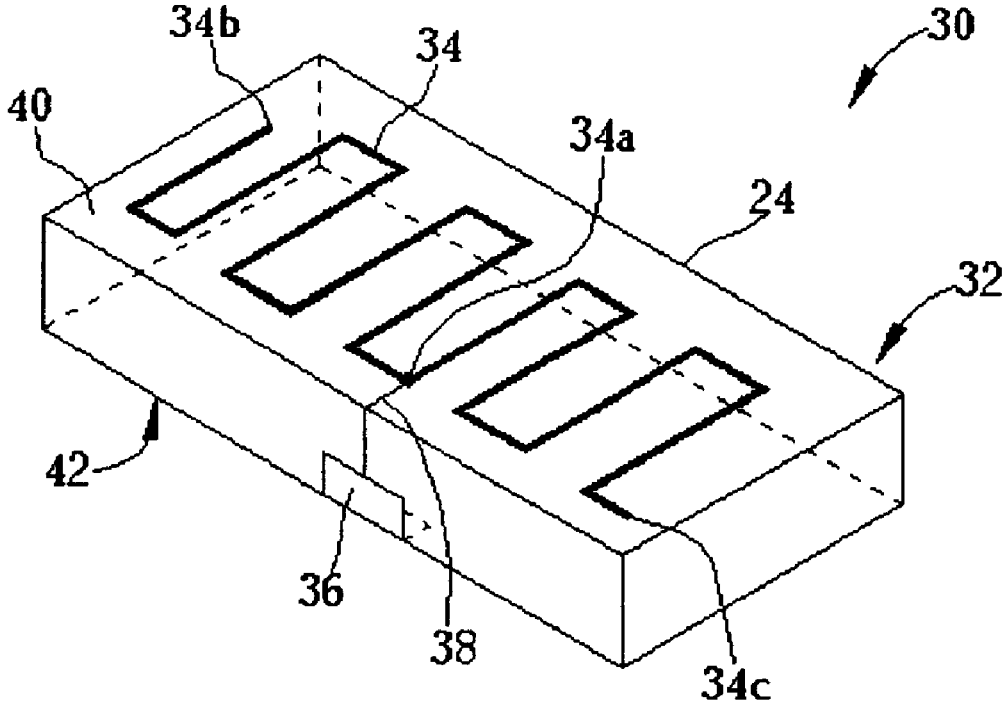
FIG. 3 is a perspective view of a microstrip meandering-line antenna according to a first embodiment of the present invention.

Please refer to FIG. 3. FIG. 3 is a perspective view of a microstrip meandering-line antenna 30 according to a first embodiment of the present invention. The microstrip meandering-line antenna 30 comprises a substrate 32, a meandering-line conductor 34, a feeding terminal 36, and a feeding wire 38. The substrate 32, which is made of a dielectric material or a magnetic material such as FR4, Teflon, glass, ceramic, plastic, or air, has a first surface 40. The meandering-line conductor 34, which is attached to the first surface 40 in a reciprocating bent manner, comprises a mid-point connection 34*a* between two ends 34*b*, 34*c* of the meandering-line conductor 34. A portion of the feeding wire 38 is disposed on the first surface 40 and is electrically connected to the feeding terminal 36 and the mid-point connection 34*a*. This connection is used for transmitting a radio signal received by the meandering-line conductor 34 to a wireless communications system (e.g., a cellular phone), or applying a voltage to the meandering-line conductor 34 to transmit a radio signal generated by the wireless communications system. The meandering-line conductor 34 is formed of a conductive metal material, e.g., gold, silver, copper, aluminum, or an alloy by printing or depositing a patterned metal conductor onto the substrate 32.

Figure 1:
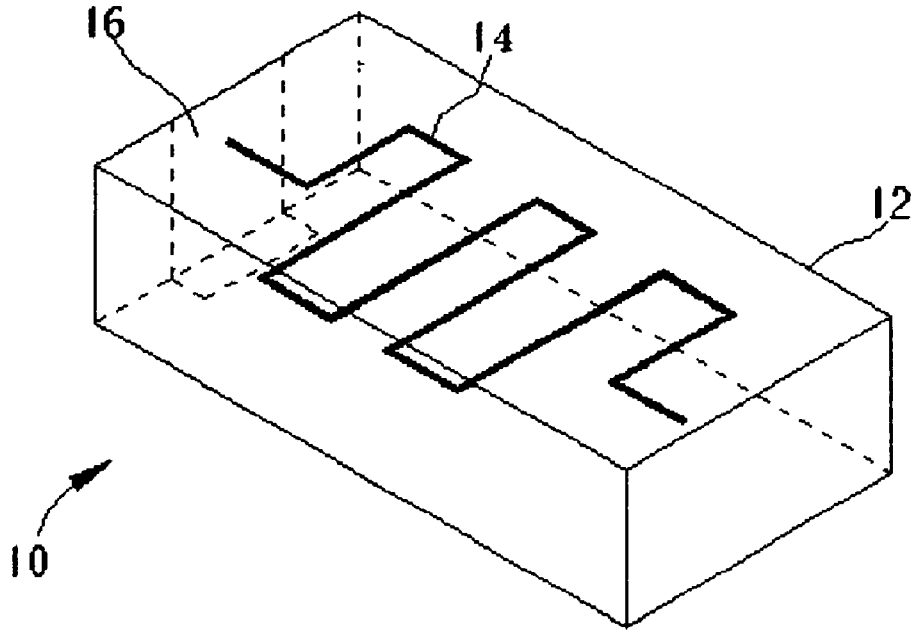
Fig. 1 Prior art
FIG. 1 is a perspective view of a microstrip meandering-line antenna according to the prior art.
Figure 2:
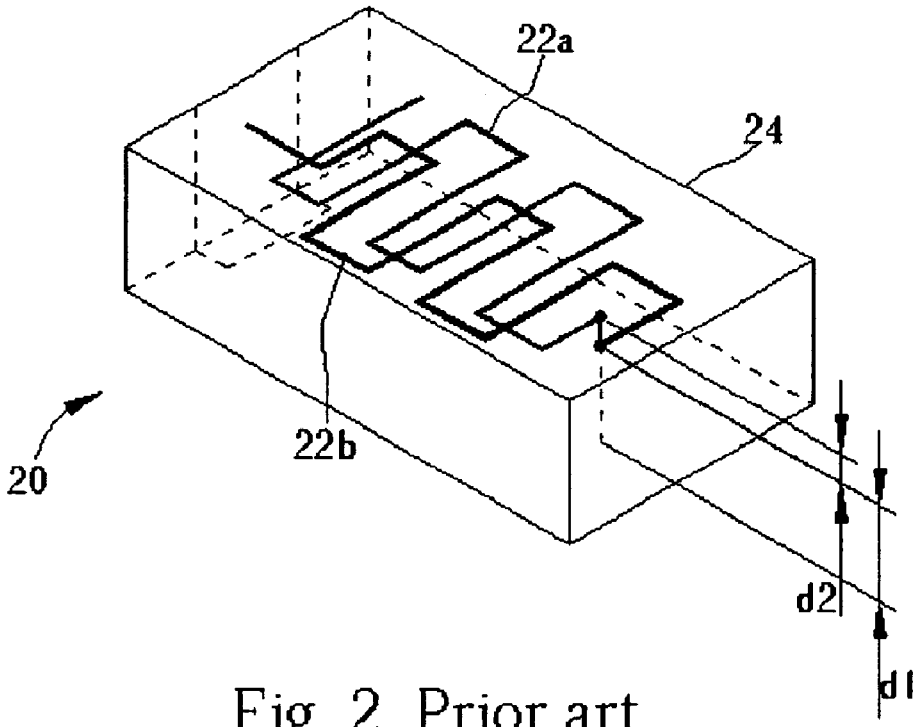
Fig. 2 Prior art
FIG. 2 is a perspective view of an alternative microstrip meandering-line antenna according to the prior art.

As shown in FIG. 3, the feeding wire 38, which is drawn from the mid-point 34*a* between two ends 34*b*, 34*c* of the meandering-line conductor 34, divides the meandering-line conductor 34 into two segments 34*a*~34*b* and 34*a*~34*c* for different frequency bands. Therefore, the present invention can be utilized in a wireless communications system with different frequency bands, such as GSM+DCS1800 (GSM: global system for mobile communication; DCS: digital cellular system), AMPS+DCS1800 (AMPS: advance mobile phone service), CDMA+DCS1800 (CDMA: code division multiple access), DCS1800+bluetooth, and DCS1800+WLAN (WLAN: wireless local area network). Furthermore, differing from the prior art meandering-line antenna 20 shown in FIG. 2, the meandering-line conductor 34 is directly attached to the first surface 40 of the substrate 32 so that the meandering-line antenna 30 has a simple structure to manufacture and still possesses a dual-band characteristic. Moreover, since the distance d2 shown in FIG. 2 is unnecessary in the present invention, the meandering-line antenna 30 is thinner than the prior art meandering-line antenna 20. Therefore, the meandering-line antenna 30 of the present invention is appropriate for the small wireless communications system, such as a cellular phone, a notebook, a personal digital assistant (PDA), a GPS device, and so forth.

Figure 4:
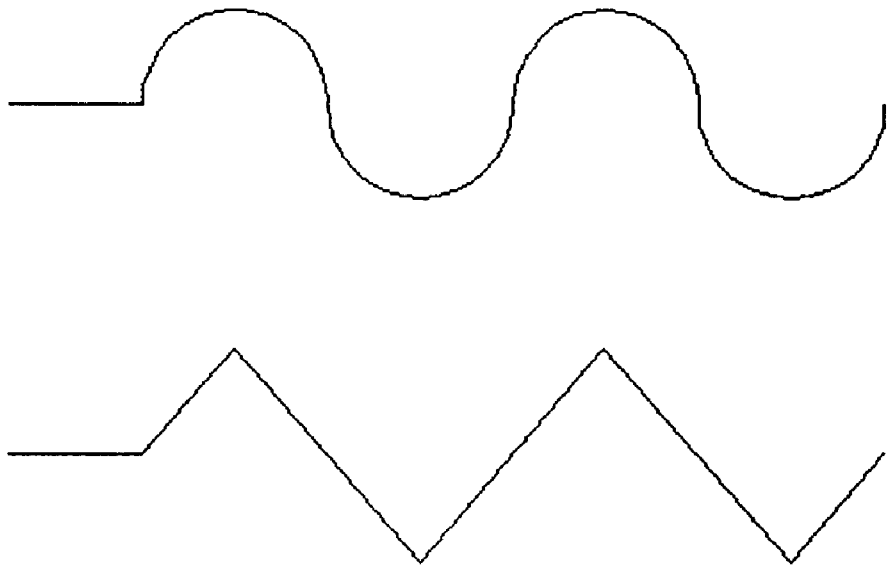
FIG. 4 is a schematic diagram of meandering-line conductors shown in FIG. 3 in different shapes.

Naturally, the meandering-line conductor 34 may be designed into a variety of meandering shapes as shown in FIG. 4. The backside surface 42 of the substrate 32 does not need to be grounded. In one embodiment, a grounding plate or a shielding plate may be installed either on a backside surface 42 of the substrate 32 or at a distance from the backside surface 42. Further, the two ends 34*b*, 34*c* of the meandering-line conductor 34 may be extended to the grounding plate or the shielding plate via an appropriate matching circuit such as a resistor, an inductor, or a capacitor. A protection layer may be formed on the first surface 40 to protect the meandering-line conductor 34.

The feeding wire 38 divides the meandering-line conductor 34 into a first segment 34*a*~34*b* and a second segment 34*a*~34*c*. The lengths, line widths, and intervals of these two portions are determined according to the corresponding resonant frequencies. Generally, the length of the first segment 34*a*~34*b* is a quarter of the corresponding wavelength or a multiple of the quarter of the corresponding wavelength. So is the length of the second segment 34*a*~34*c*. The line widths and the intervals of the first segment 34*a*~34*b* and the second segment 34*a*~34*b* need not be the same. Typically, a wider interval of the segment corresponds to a wider frequency band, thus the first segment 34*a*~34*b* may be bent at a first interval and the second segment 34*a*~34*c* may be bent at a second interval so as to modify the corresponding frequency bands respectively. In addition to the length of the meandering-line conductor 34, the length and position of the feeding wire 38, or the distance between the grounding plate and the meandering-line conductor 34 may also be modified to decrease the working frequency.

Figure 5:
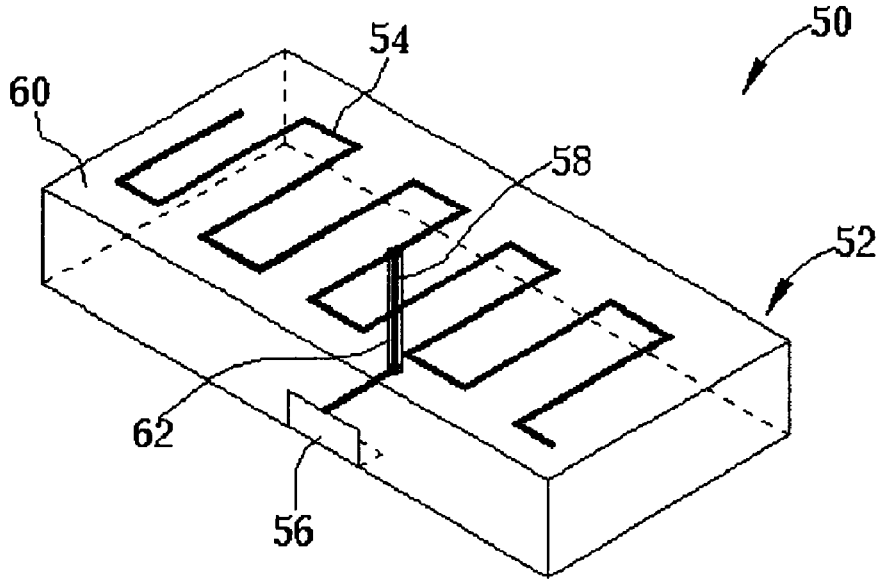
FIG. 5 is a perspective view of a microstrip meandering-line antenna according to a second embodiment of the present invention.

Please refer to FIG. 5. FIG. 5 is a perspective view of a microstrip meandering-line antenna 50 according to a second embodiment of the present invention. The microstrip meandering-line antenna 50 comprises a substrate 52, a meandering-line conductor 54, a feeding terminal 56, and a feeding wire 58. The substrate 52 has a first surface 60 and a via hole 62. Differing from the first embodiment, the feeding wire 58 of the microstrip meandering-line antenna 50 is electrically connected to the feeding terminal 56 through the via hole 62 rather than through the first surface 60.

Figure 6:
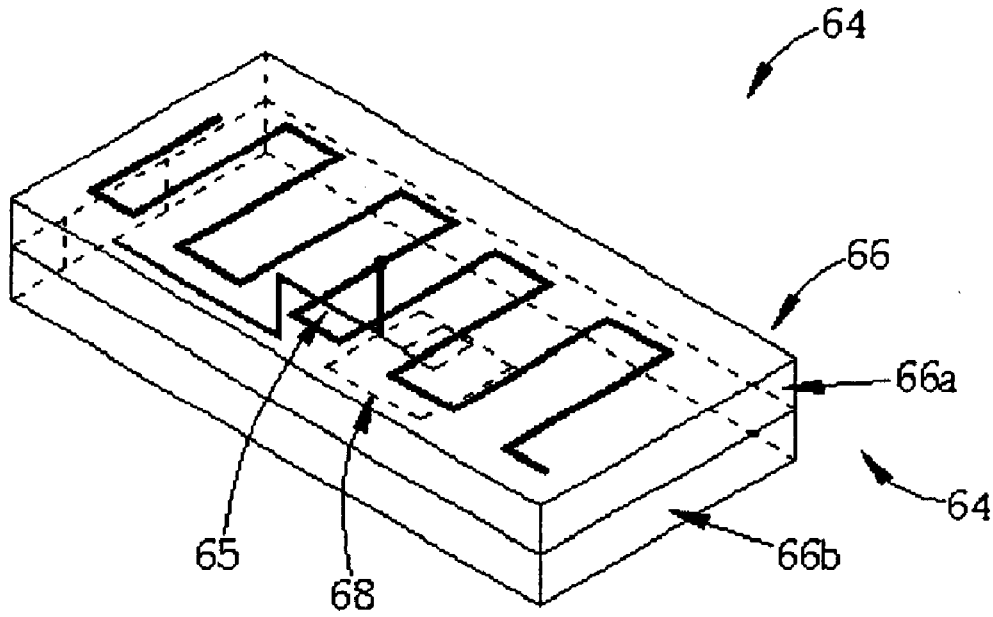
FIG. 6 is a perspective view of a microstrip meandering-line antenna according to a third embodiment of the present invention.

Please refer to FIG. 6. FIG. 6 is a perspective view of a microstrip meandering-line antenna 64 according to a third embodiment of the present invention. Differing from the above two embodiments, a substrate 66 of the microstrip meandering-line antenna 64 comprises a first layer 66*a* and a second layer 66*b*. A matching circuit 68 is disposed between the first layer 66*a* and the second layer 66*b* and electrically connected to a feeding wire 65 of the microstrip meandering-line antenna 64 so as to shrink the volume of the whole wireless communications system.

Figure 7:
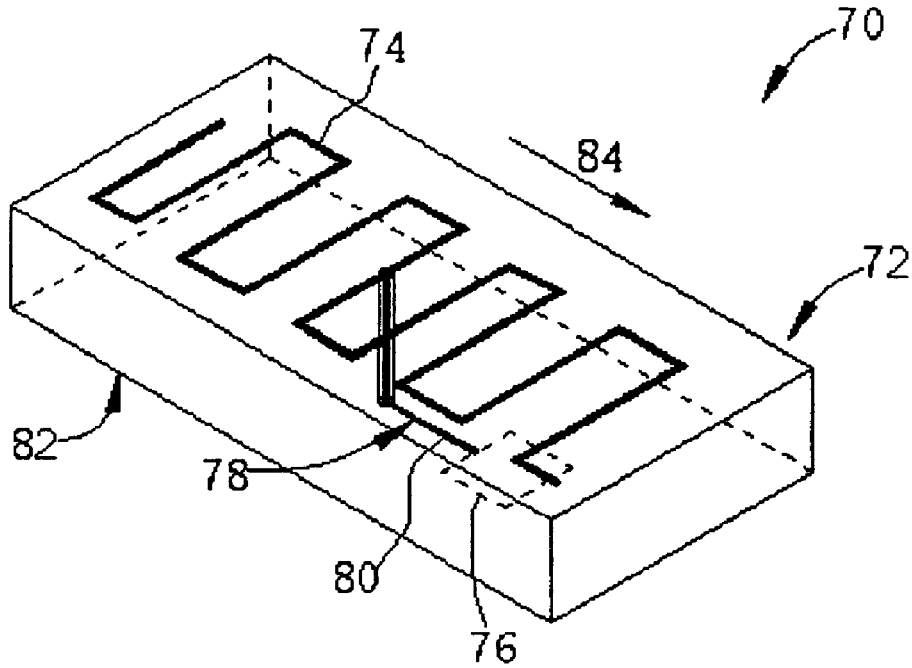
FIG. 7 is a perspective view of a microstrip meandering-line antenna according to a fourth embodiment of the present invention.

Please refer to FIG. 7. FIG. 7 is a perspective view of a microstrip meandering-line antenna 70 according to a fourth embodiment of the present invention. The microstrip meandering-line antenna 70 comprises a substrate 72, a meandering-line conductor 74, a feeding terminal 76, and a feeding wire 78. In contrast to the above-mentioned three embodiments, the feeding wire 78 of the microstrip meandering-line antenna 70 has a frequency-modifying portion 80, which is installed on a second surface 82 of the substrate 72 and is approximately parallel to an extension direction 84 of the meandering-line conductor 74. As shown in FIG. 7, since the frequency-modifying portion 80 of the feeding wire 78 is installed under the meandering-line conductor 74 and is parallel to the extension direction 84, the frequency-modifying portion 80 can produce a strong electromagnetic coupling (EMC) with the meandering-line conductor 74. Therefore, changing the length of the frequency-modifying portion 80 can modify the resonant frequency of the microstrip meandering-line antenna 70.

Figure 8:
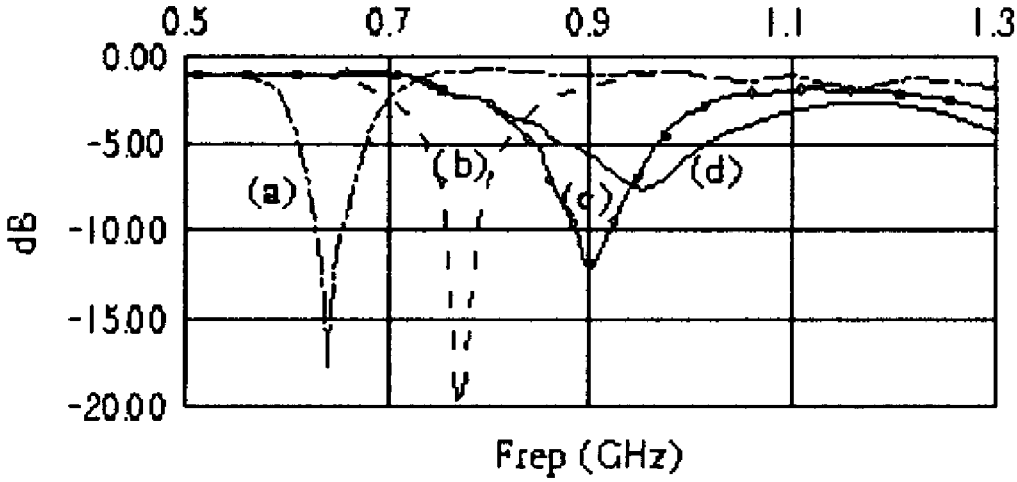
FIG. 8 is a correlation diagram illustrating the dependence between the resonant frequency and the length of the frequency-modifying portion of the feeding wire shown in FIG. 7.
Figure 8:
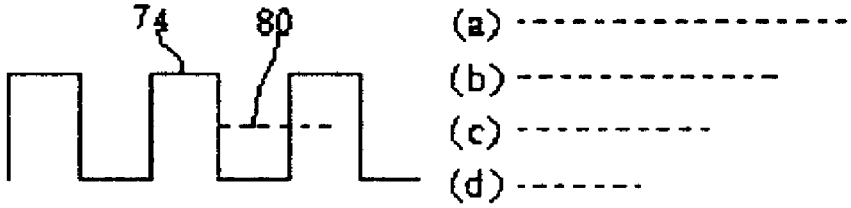

Please refer to FIG. 8. FIG. 8 is a correlation diagram illustrating the dependence between the resonant frequency and the length of the frequency-modifying portion 80 of the feeding wire 78 shown in FIG. 7. The data shown in FIG. 8 is a simulation result analyzed by electromagnetic analysis software. The resonant frequency of the microstrip meandering-line antenna 70 varies with the length of the frequency-modifying portion 80 of the feeding wire 78. As shown in FIG. 8, a longer length of the frequency-modifying portion 80 corresponds to a lower resonant frequency of the microstrip meandering-line antenna 70. Thus, it is an advantage of the present invention that the resonant frequency can be lowered by increasing the length of the frequency-modifying portion 80 without expanding the dimensions of the meandering-line conductor 74.

Figure 9:
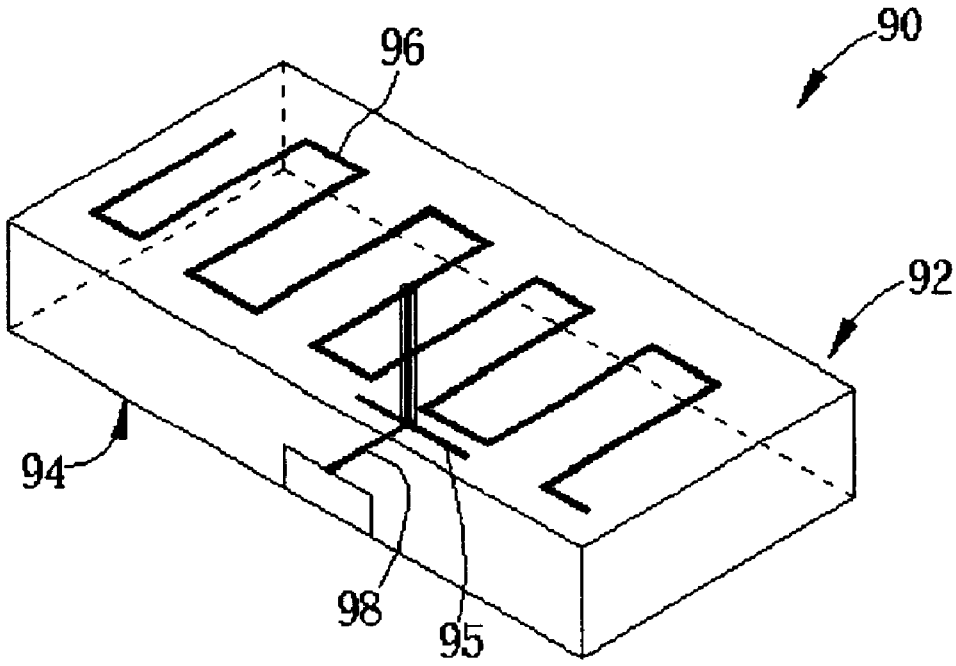
FIG. 9 is a perspective view of a microstrip meandering-line antenna according to a fifth embodiment of the present invention.

Please refer to FIG. 9. FIG. 9 is a perspective view of a microstrip meandering-line antenna 90 according to a fifth embodiment of the present invention. Differing from the fourth embodiment, the microstrip meandering-line antenna 90 comprises a frequency-modifying line 95, which is installed on a second surface 94 of a substrate 92 and is electrically connected to a feeding wire 98 in a crossing manner. As shown in FIG. 9, the frequency-modifying line 95 is installed under the meandering-line conductor 96 and is approximately parallel to an extension direction of the meandering-line conductor 96. The frequency-modifying line 95 acts in a similar manner with the frequency-modifying portion 80 in FIG. 7 so as to produce an electromagnetic coupling with the meandering-line conductor 96. Therefore, changing the length of the frequency-modifying line 95 can modify the resonant frequency of the microstrip meandering-line antenna 90.

Figure 10:
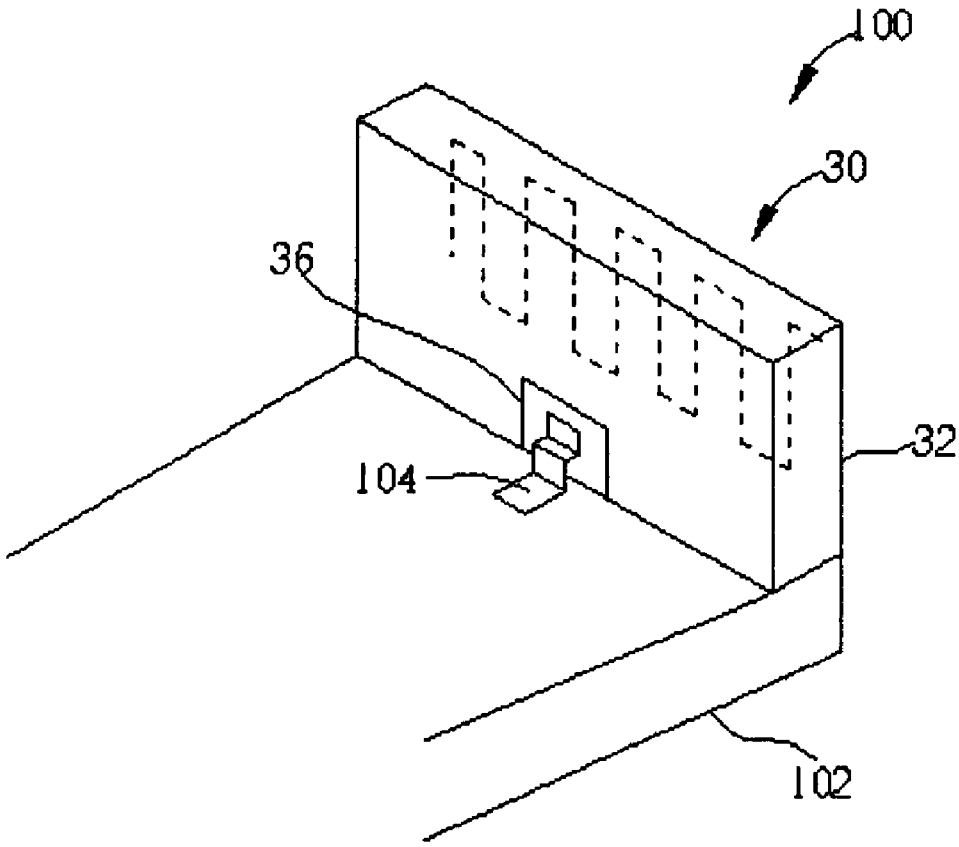
FIG. 10 is a perspective view of a layout of the microstrip meandering-line antenna shown in FIG. 3.

Please refer to FIG. 10. FIG. 10 is a perspective view of a layout of the microstrip meandering-line antenna 30 shown in FIG. 3. The microstrip meandering-line antenna 30 of the present invention can be deposited within a wireless communications system 100, such as a cellular phone. As shown in FIG. 10, the wireless communications system 100 comprises a system circuit board 102 for control operation of the wireless communications system 100, and a metal clip 104, which is installed on the system circuit board 102 and is electrically connected to the feeding terminal 36. The substrate 32 is set approximately perpendicular to the system circuit board 102 in the wireless communications system 100, such that the microstrip meandering-line antenna 30 can be integrated with the system circuit board 102. Naturally, the substrate 32 may also be set parallel to the system circuit board 102 as well. Additionally, the layout of the microstrip meandering-line antenna 30 in the wireless communications system 100 described above can be applied to all of the embodiments previously mentioned.

According to the present invention, a microstrip meandering-line antenna comprises a meandering-line conductor formed with a shape of a circle, a saw-tooth, or a square in a reciprocating bent manner. Two ends of the meandering-line conductor may be open circuits or short circuits. In the case of the short circuits, one end (or both ends) of the meandering-line conductor may be extended to ground with a resistor, an inductor, or a capacitor. A feeding wire of the present invention is drawn from a mid-point connection between the two ends of the meandering-line conductor either along a surface or through a via hole. As the meandering-line antenna adopts a multi-layer structure, the feeding wire is wired between layers and is drawn from a front or a backside surface of the substrate through the via hole.

In contrast to the prior art, the meandering-line conductors 34, 54, 74, 96 of the meandering-line antenna 30, 50, 64, 70, 90 according to the present invention are attached to the first surface 40, 60, and the feeding wires 38, 58, 65, 78, 98 are drawn from the mid-point 34*a* between the two ends 34*b*, 34*c* of the meandering-line conductor, so that the meandering-line antenna of the present invention has a great effect upon operation in two or more separate frequency bands and occupies less space. Moreover, the meandering-line antenna of the present invention comprises the frequency-modifying portion 80 or/and the frequency-modifying line 95 so as to modifying the resonant frequency without an increase of the volume of the meandering-line conductors 34, 54, 74, 96.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A meandering-line antenna for a wireless communications system, the meandering-line antenna comprising:

a substrate having a first surface;

a meandering-line conductor attached to the first surface in a reciprocating bent manner for receiving radio signals, the meandering-line conductor having a mid-point connection between two ends of the meandering-line conductor; and a feeding wire electrically connected to the mid-point connection for transmitting a received radio signal to the wireless communications system, wherein the substrate further comprises a via hole through which a portion of the feeding wire is disposed.

2. The meandering-line antenna of claim 1 wherein the mid-point connection divides the meandering-line conductor into a first segment bent at a first interval and a second segment bent at a second interval.

3. The meandering-line antenna of claim 1 wherein the mid-point connection divides the meandering-line conductor into a first segment and a second segment, further, line widths of the first segment and the second segment are different.

4. The meandering-line antenna of claim 1 further comprising a feeding terminal on the substrate, and the feeding wire is electrically connected to the feeding terminal and to the mid-point connection.

5. The meandering-line antenna of claim 1 wherein the wireless communications system comprises a system circuit board, and the substrate is set approximately perpendicular to the system circuit board in the wireless communications system.

6. The meandering-line antenna of claim 1 wherein the substrate is made of a dielectric material or a magnetic material.

7. An antenna comprising:

a substrate having a first surface;

a meandering-line conductor formed on the first surface in a reciprocating bent manner along a first direction for receiving radio signals, the meandering-line conductor having a mid-point connection between two ends of the meandering-line conductor, and the mid-point connection dividing the meandering-line conductor into a first segment and a second segment, the first segment having a first resonant frequency and the second segment having a second resonant frequency being different from the first resonant frequency;

a feeding wire electrically connected to the mid-point connection for transmitting a received radio signal to the wireless communications system, the feeding wire having a frequency-modifying portion extending along a second direction approximately parallel to the first direction for modifying the first resonant frequency or the second resonant frequency.

8. A meandering-line antenna for a wireless communications system, the meandering-line antenna comprising:

a substrate having a first surface;

a meandering-line conductor attached to the first surface in a reciprocating bent manner for receiving radio signals, the meandering-line conductor having a mid-point connection between two ends of the meandering-line conductor; and a feeding wire electrically connected to the mid-point connection for transmitting a received radio signal to the wireless communications system, the feeding wire having a frequency-modifying portion for modifying a resonant frequency of the meandering-line antenna.

9. The meandering-line antenna of claim 8 wherein the meandering-line conductor extends along a predetermined direction and the frequency-modifying portion of the feeding wire is approximately parallel to the predetermined direction.

10. The meandering-line antenna of claim 8 wherein the substrate further comprises a second surface, the frequency-modifying portion of the feeding wire disposed on the second surface.

11. A meandering-line antenna for a wireless communications system, the meandering-line antenna comprising:

a substrate having a first surface;

a meandering-line conductor attached to the first surface in a reciprocating bent manner for receiving radio signals, the meandering-line conductor having a mid-point connection between two ends of the meandering-line conductor;

a feeding wire electrically connected to the mid-point connection for transmitting a received radio signal to the wireless communications system; and a frequency-modifying line electrically connected to the feeding wire in a crossing manner for modifying a resonant frequency of the meandering-line antenna.

12. The meandering-line antenna of claim 11 wherein the meandering-line conductor extends along a predetermined direction and the frequency-modifying line is approximately parallel to the predetermined direction.

13. The meandering-line antenna of claim 11 wherein the substrate further comprises a second plane, the frequency-modifying line disposed on the second plane.

* * * * *